US011109668B2

(12) United States Patent
Goldfarb

(10) Patent No.: US 11,109,668 B2
(45) Date of Patent: Sep. 7, 2021

(54) WAXING APPARATUS

(71) Applicants: Liran Yechiel Halfon, Sde Eliezer (IL); Sigalit Goldfarb, Sde Eliezer (IL)

(72) Inventor: Sigalit Goldfarb, Sde Eliezer (IL)

( * ) Notice: Subject to any disclaimer, the term of this patent is extended or adjusted under 35 U.S.C. 154(b) by 0 days.

(21) Appl. No.: 16/477,207

(22) PCT Filed: Feb. 5, 2018

(86) PCT No.: PCT/IL2018/050125
§ 371 (c)(1),
(2) Date: Jul. 11, 2019

(87) PCT Pub. No.: WO2018/142412
PCT Pub. Date: Aug. 9, 2018

(65) Prior Publication Data

US 2019/0387870 A1 Dec. 26, 2019

Related U.S. Application Data

(60) Provisional application No. 62/454,850, filed on Feb. 6, 2017.

(51) Int. Cl.
*A46B 11/08* (2006.01)
*A45D 26/00* (2006.01)
(Continued)

(52) U.S. Cl.
CPC ..... *A46B 11/08* (2013.01); *A45D 26/0014* (2013.01); *A45D 40/28* (2013.01);
(Continued)

(58) Field of Classification Search
CPC ..... A45D 26/0014; A45D 26/00; A45D 26/0019; A45D 40/28; A45D 2200/055; A45D 2200/0054; A45D 2200/10; A45D 2200/15; A45D 2200/152; A45D 2200/155; A45D 2200/157; A46B 11/08;
(Continued)

(56) References Cited

U.S. PATENT DOCUMENTS 4,465,073 A * 8/1984 Schwob ..... A45D 26/0014 222/146.5
4,553,935 A * 11/1985 Ueno ..... A61C 13/0028 222/146.5
(Continued)

FOREIGN PATENT DOCUMENTS

| | | | |
|---|---|---|---|
| EP | 0592340 | A1 | 4/1994 |
| FR | 2467786 | A1 | 4/1981 |
| WO | 2007051526 | A1 | 5/2007 |

OTHER PUBLICATIONS

Europeam Search Report; European Patent Office; The Hague; dated Nov. 8, 2019.

*Primary Examiner* — David J Walczak
(74) *Attorney, Agent, or Firm* — PatShegen IP; Moshe Pinchas

(57) ABSTRACT

A waxing apparatus including a dispenser having a compartment for holding wax and a tip having an aperture for dispensing wax on a user skin, the tip including a gradually decreasing cross section in the direction towards the aperture; and a heating element mounted over the compartment and over the tip and configured such that temperature inside the tip is higher than temperature inside the compartment.

16 Claims, 4 Drawing Sheets

(51) Int. Cl.
*A45D 40/28* (2006.01)
*B05C 17/005* (2006.01)

(52) U.S. Cl.
CPC .... *A45D 2200/055* (2013.01); *A45D 2200/10* (2013.01); *A45D 2200/155* (2013.01); *B05C 17/00523* (2013.01); *B05C 17/00526* (2013.01); *B05C 17/00533* (2013.01)

(58) Field of Classification Search
CPC ..... B05C 17/00523; B05C 17/00526; B05C 17/0053; B05C 17/00533; B05C 17/0054; B05C 17/00543; B05C 17/00546
USPC ..... 401/1, 2, 150, 171, 172, 173, 174, 176, 401/179
See application file for complete search history.

(56) References Cited

U.S. PATENT DOCUMENTS

| | | | | |
|---|---|---|---|---|
| 5,848,850 | A | 12/1998 | Seb | |
| 6,585,511 | B2 * | 7/2003 | Dragan | B05C 17/00593 401/176 |
| 6,709,180 | B2 * | 3/2004 | Cochran | A45D 26/0014 219/201 |
| 2008/0142495 | A1 | 6/2008 | Des Garets | |
| 2009/0087247 | A1 | 4/2009 | Jennings | |
| 2014/0054319 | A1 * | 2/2014 | Shin | A61C 13/0028 222/146.5 |
| 2014/0236182 | A1 | 8/2014 | Reynolds | |

* cited by examiner

WAXING APPARATUS

FIELD OF INVENTION

The presently disclosed subject matter relates to a waxing apparatus in general and in particular to a hair removal waxing apparatus.

BACKGROUND

People often have unwanted hair, such as hair on their legs, faces, backs, etc. Razors have been common device for removing unwanted hair. Razors usually require the person to shave every day. Waxing has become more common in recent times. It is more effective in removing hair and usually lasts for a week or two weeks or longer. The prevailing method of depilatory and epilatory wax implementation/application is antiquated, unsanitary/unsafe and inaccurate. This method most commonly involves the manual manipulation of a wooden spatula into a communal vat of melted wax or other depilatory product, which is then guided to the intended area, with varying degrees of accuracy/success.

US 20140236182 discloses a device for removing unwanted hair includes a housing having a first end and a second end. The first end holds a depilatory product and has a cylindrical shape with a circular opening. A second end has a conical shape with a shaped opening. A plunger fits in the circular opening and mates with the cylindrical shape of the first end of the housing. The housing is made of a rigid polymer and is a microwave safe material. US 20140236182 discloses a method of removing unwanted hair includes the steps of heating a syringe containing a wax until the wax is in a liquid state. A tip of the syringe is placed next to an area of hair to be removed. The wax is applied to the area of hair. Then the wax is manually removed when in solid form or by applying fabric/paper strips.

US 20090087247 discloses a low voltage battery operated handheld waxing depilatory device used to remove unwanted body hair quickly, safely and with ease by allowing a depilatory wax stick to enter an opening in the battery door through which the wax stick is conveyed by the battery/wax stick support by the Advance Assembly lever which guides it towards and through the Heating Element Guide to the Heating Element where the wax reaches it melting point then is gentle forced by the Advance Assembly lever causing the melted wax to pass through the Heating Element's opening to the reach the surface where it is being applied.

SUMMARY OF INVENTION

According to an aspect of the presently disclosed subject matter a waxing apparatus including a dispenser having a compartment for holding wax and a tip having an aperture for dispensing wax on a user skin, the tip including a gradually decreasing cross section in the direction towards the aperture; and a heating element mounted over the compartment and over the tip and configured such that temperature inside the tip is higher than temperature inside the compartment.

The waxing apparatus can further include an applicator for applying the wax on a surface the skin. The applicator can include an edge configured sized and shaped in accordance with a skin surface on which the melted wax is to be applied. The applicator can be replaceably mounted on the dispenser such that various applicators can be used for various skins surfaces.

The waxing apparatus can further include a housing and wherein the dispenser includes a wax compartment having an insertion opening for inserting therein wax, and wherein the dispenser is a removably coupled to the housing allowing thereby insertion of the wax to the wax compartment.

The heating element can be configured to form a temperature gradient inside the compartment and the tip in the direction from the compartment to the aperture.

The heating element can be configured such that temperature of the wax in the tip is higher than temperature of portions of the wax disposed in the compartment.

The heating element can be configured to heat the wax inside the tip to a temperature of 50-65° and to heat the wax in the compartment to a temperature of 45-50°.

The heating element can be configured such that the wax inside the compartment is relatively rigid with respect to wax inside the tip.

The dispenser can include a casing member configured to encase the compartment as well as the heating element, and includes flange configured for removable coupling to a corresponding flange on a housing of the apparatus.

The waxing apparatus can further include a dispensing mechanism for dispensing the wax out of the compartment. The dispensing mechanism can include a plunger configured to be inserted into the compartment and to urge the wax therein towards the tip.

The plunger further can include a conic head corresponding to a conic head of the tip. The dispensing mechanism can further include a motor and a motion converter for converting rotational motion of the motor to linear motion; the motion converter is coupled to the plunger and configured to urge the plunger inside the compartment.

The motion converter can include a sleeve having a screw thread defined on the inner surface thereof, and a bolt member having a corresponding screw thread defined on the outer surface thereof, wherein the bolt member is configured to rotate inside the sleeve, such that by engagement of the screw threads, rotation of the bolt member inside the sleeve causes a linear displacement of the bolt member with respect to the sleeve.

The sleeve can be coupled to the motor and the bolt member is coupled to a rotating shaft of the motor, such that rotation of the shaft facilitates liner displacement of the bolt member with respect to the sleeve.

The bolt member and the sleeve can be configured such that an outmost position of the bolt member with respect to the sleeve corresponds to an inmost position of the plunger with respect to the compartment. The motor can be configured to rotate in a first direction such that the bolt member is displaced inside the sleeve towards the compartment, and in a second direction by which the bolt member is displaced inside the sleeve away from the compartment.

The motor can be configured to automatically change the rotational direction from the first direction to the second direction as the bolt member reaches the outmost position and to change the rotational direction from the second direction to the first direction when the bolt member is fully disposed inside the sleeve.

The waxing apparatus can further include an actuator configured for controlling the duration of rotation of the motor controlling thereby the amount of melted wax which is dispensed from the dispenser.

BRIEF DESCRIPTION OF THE DRAWINGS

In order to understand the disclosure and to see how it may be carried out in practice, embodiments will now be described, by way of non-limiting examples only, with reference to the accompanying drawings, in which.

DETAILED DESCRIPTION OF EMBODIMENTS

Figure 1:
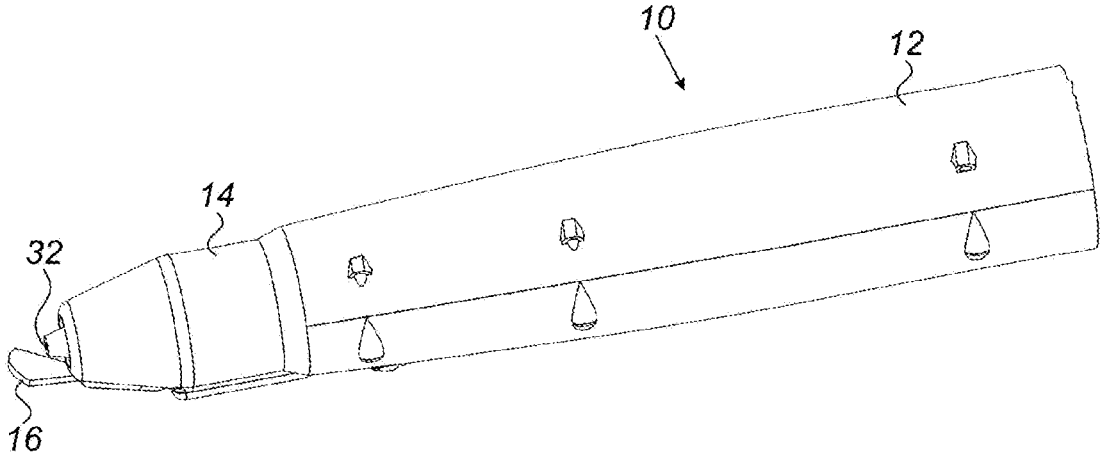
FIG. 1 is a top perspective view of the waxing apparatus in accordance with an example of the presently disclosed subject matter.
Figure 2:
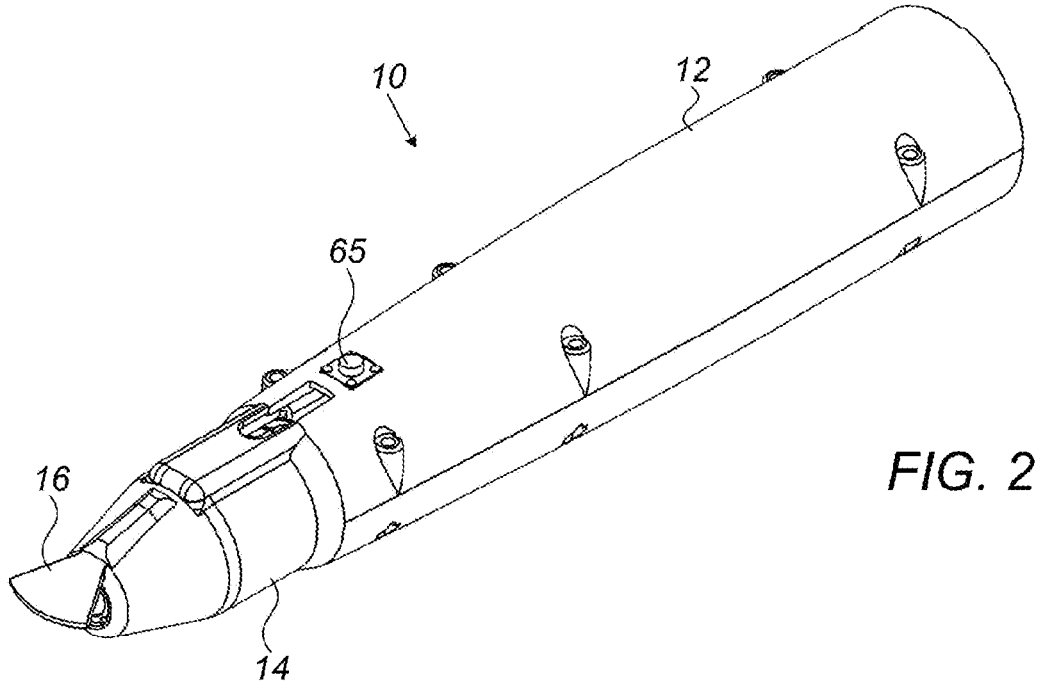
FIG. 2 is a bottom perspective view of the waxing apparatus of FIG. 1.

FIGS. 1 and 2 is a side perspective view of the waxing apparatus 10 according to an example of the presently disclosed subject matter. The apparatus 10 is includes a housing 12 configured with an ergonomic surface configured to be held with the palm of a user. The apparatus 10 includes a dispenser 14 for dispensing melted wax, and an applicator 16 for applying the wax on a surface, such as a skin surface of a user.

The dispenser 14 is a removably coupled to the housing 12, such that it can be removed for inserting therein wax, as described herein below.

Figure 3:
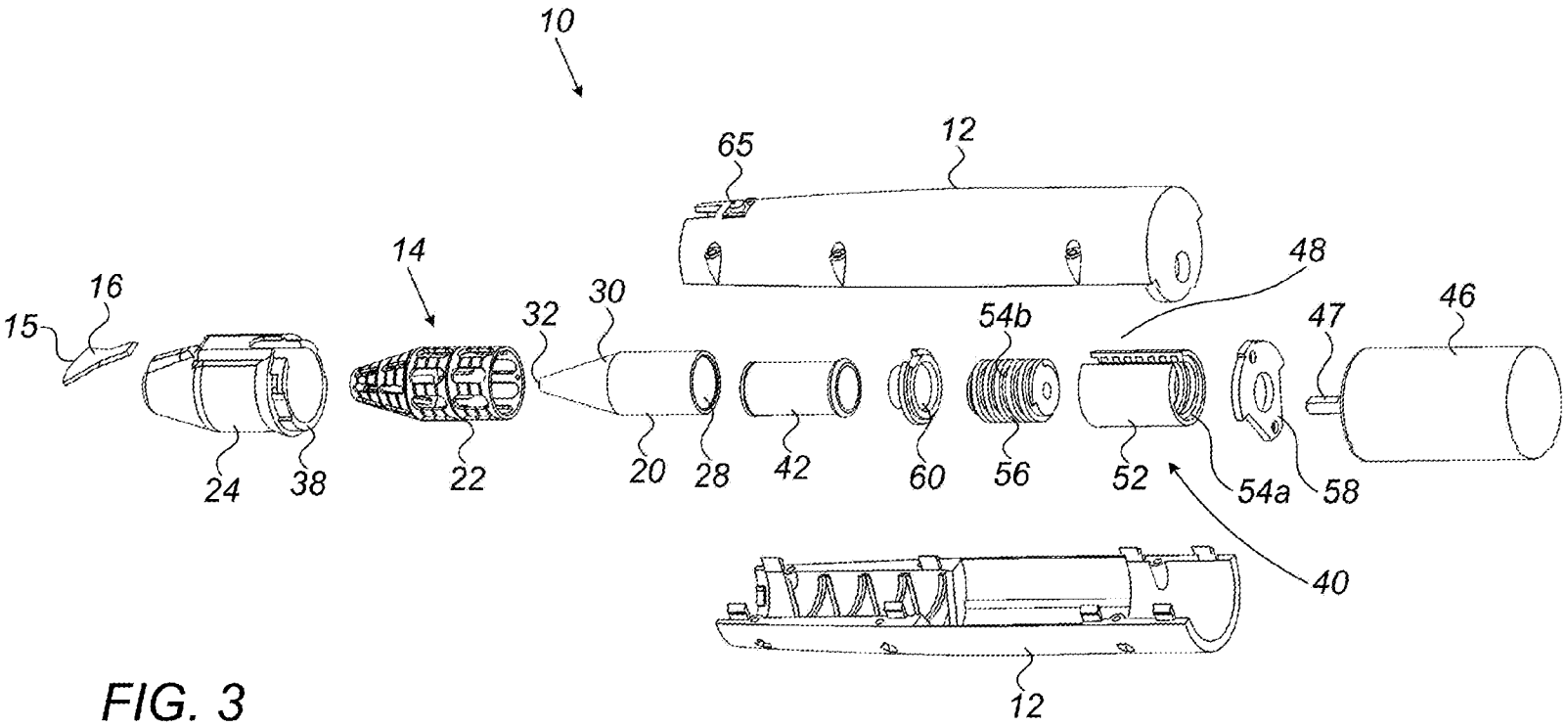
FIG. 3 is an exploded view of the waxing apparatus of FIG. 1.
Figure 4:
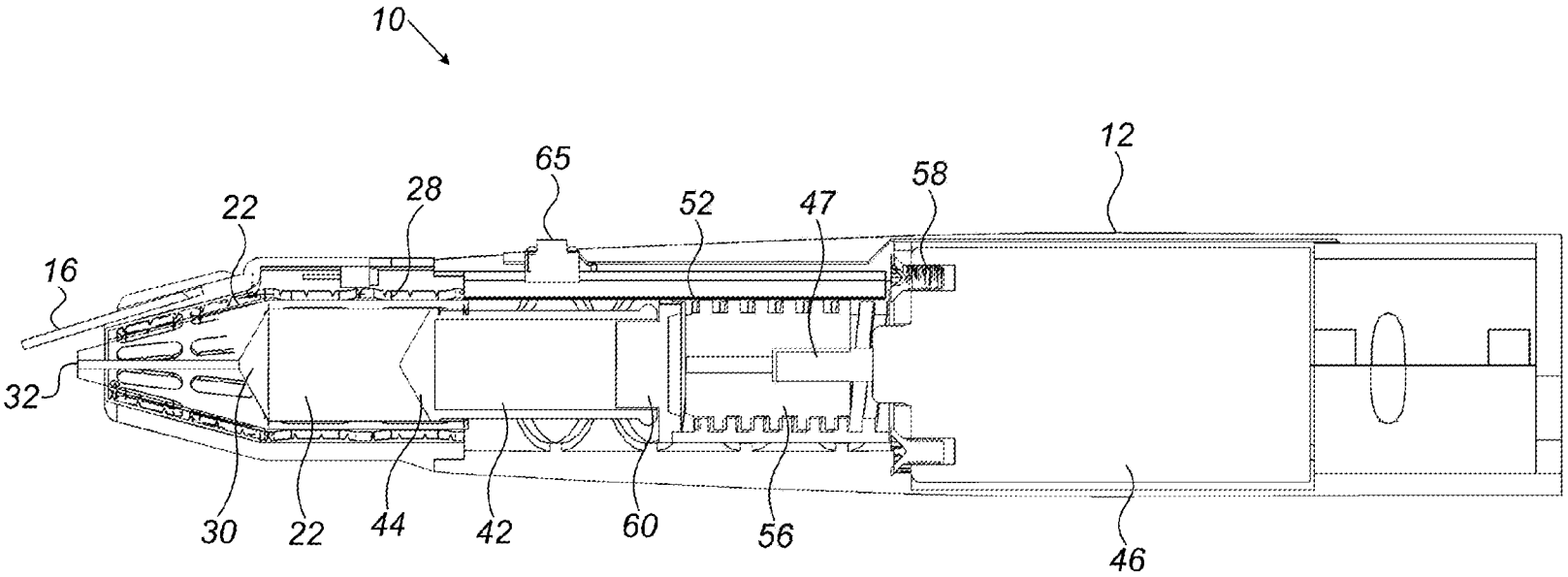
FIG. 4 is a side sectional view of the waxing apparatus of FIG. 1.

As shown in FIGS. 3 and 4, the dispenser 14 includes a wax compartment 20 having an insertion opening 28 for inserting therein wax, such as solid was rods, and a heating element 22 mounted over the compartment and configured to heat the wax therein. The compartment 20 includes a tip 30 having an aperture 32 for dispensing melted wax from the compartment 20. The tip, which is illustrated here as having a conic shape includes a gradually decreasing cross section in the direction towards the aperture 32, facilitating thereby the extraction of the proper amount of melted wax. The heating element 22 is mounted over the compartment 20 as well as the tip 30, such that the wax in the compartment 20 and that which is in the tip 30 is gradually melted. In other words, the dispenser of the present invention provides a gradually melting wax, i.e. the wax rod which is inserted into the compartment, is heated such that the portions of the rod disposed close to the insertion opening 28 are only slightly melted and can be pushed into the tip 30 of the compartment 20. Since the tip 30 has a gradually decreasing cross section, the heating element mounted over the tip 30 heats the wax to a higher temperature than the temperature of portions of the wax disposed closer to the insertion opening 28. I.e. the heating element 22 forms a temperature gradient between the insertion opening 28 and the aperture 32. This way, the wax which is not inside the tip of the compartment 20 is heated, however maintains some of its solidity, while the wax in the tip is melted such that it can be dispensed through the aperture 32 and can be applied on the user's skin. Maintaining a certain degree of solidity to the wax rod disposed out of the tip 30 facilitated mechanically pushing the wax rod towards the tip, as explained hereinafter.

According to an example, the heating element is configured to heat the wax inside the tip 30 to the temperature of 50-65° and to heat the wax in the compartment 20 to the temperature of 45-50°. This way, the wax rod inside the compartment is relatively rigid and can be pushed, while the wax inside the tip 30 is melted and can be easily dispensed.

It is appreciated that the heating element 22 can configured to vary the temperature of the wax inside the compartment 20 or the tip 30 in other manners. For example, the heating element can be a coil configured to radiate heat into the compartment 20 and can be configured with varying width such that about the tip the heating element 22 radiates more heat. Similarly, the heating element can include threads disposed with higher density about the tip 30 such that more heat is radiated about the tip 30.

In addition, the dispenser 14 includes a casing member 24 configured to be removably coupled to the housing 12. The casing member 24 is configured to encase the compartment 20 as well as the heating element 22, and a flange 38 configured for coupling to a corresponding flange on the housing 12. For example, the flange can be configured for snap coupling, or can include a thread or any other known coupling which allows removing the dispenser 14 from the housing 12.

The dispenser 14 further includes an applicator 16 for applying the wax on a surface, the applicator 16 can include an edge 15 configured to spread the melted wax over the user's skin. It is appreciated that the size and shape of the edge can be configured in accordance with the skin surface on which it is desired to apply the wax. For example, the edge 15 can include a wider surface when it is desired to spread the melted wax over a relatively large skin surface area, or a narrow surface when it is desired to spread the melted wax over a relatively small skin surface area. This way the applicator 16 can be configured either for spreading wax in the exact locations, such that a narrow applicator can be used for example to remove hair from eyebrows or to be used for spreading wax on lager areas such as legs etc. In addition, the edge 15 can be configured with a rounded surface corresponding to rounded skin surfaces, such as skin over the leg or in skin over the chin area. According to an example, the applicator 16 can be replaceably mounted on the casing member 24, such that various applicators can be used for various skins surfaces. The waxing apparatus 10 can thus be provided with a kit of applicators 16 each of which for treating a certain type of skin surface.

Figure 5:
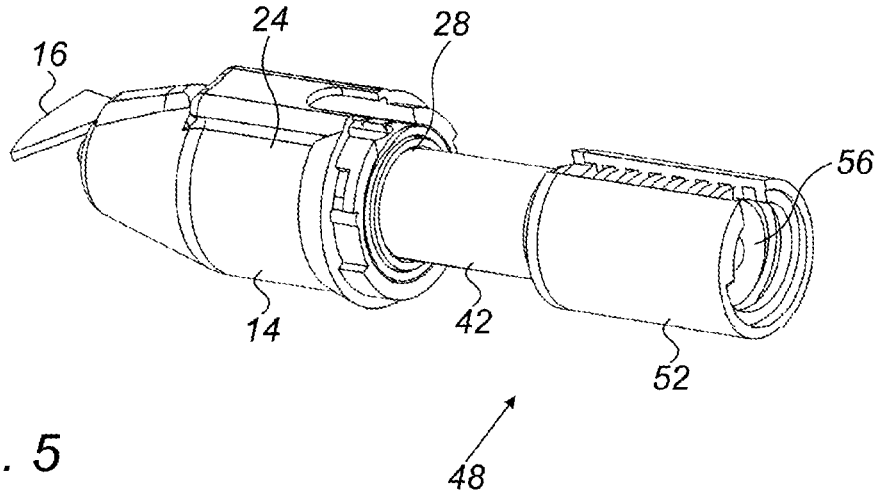
FIG. 5 is top perspective view of the dispensing mechanism of the waxing apparatus of FIG. 1 in an assembled position.
Figure 6:
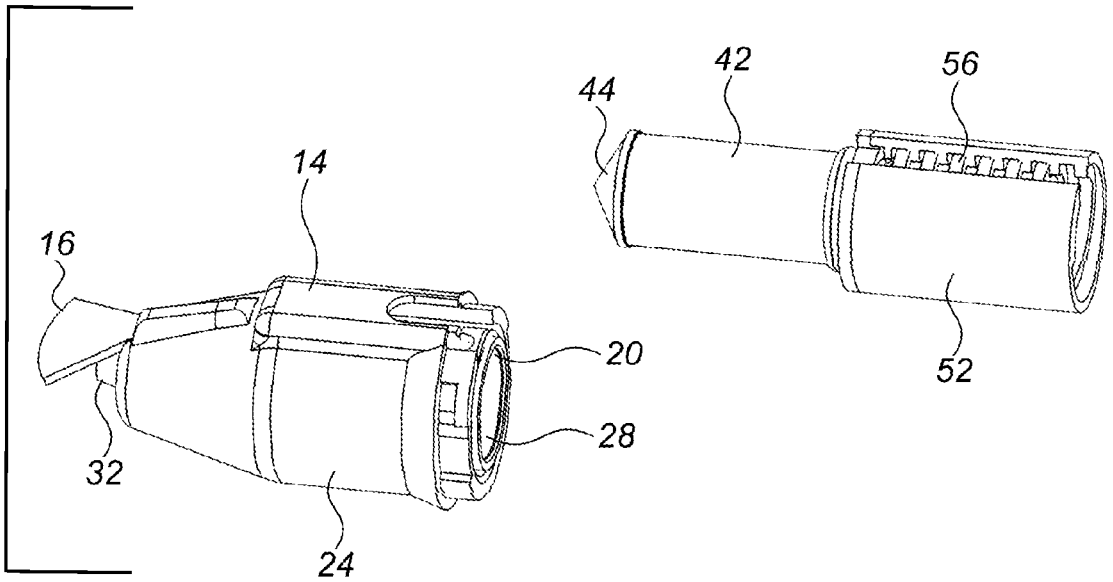
FIG. 6 is top perspective view of the dispensing mechanism of FIG. 4 and a dissembled position.

Turning now to FIGS. 5 and 6 the apparatus 10 includes a dispensing mechanism 40 for dispensing the wax oat of the compartment 20. The dispensing mechanism 40 includes a plunger 42 configured to be inserted into the compartment 20 via the insertion opening 28 and to urge the wax therein towards the tip 30.

According to an example, the plunger 42 further includes a conic head 44 corresponding to the tip 30, such that when the all the wax in the compartment 20 is inside the tip 30 portion the conic head 44 protrudes into the tip 30 and urges the remaining wax out of the tip 30.

The dispensing mechanism 40 further includes a motor 46, which can be an electric motor having a rotating shaft 47, and a motion converter 48, for converting the rotational motion of the motor to linear motion of the plunger. The motion converter 48 according to the present example includes a sleeve 52 having a screw thread 54*a* defined on the inner surface thereof, and a bolt member 56 having a corresponding screw thread 54*b* defined on the outer surface thereof. The bolt member 56 is configured to rotate inside the sleeve 52, and due to the engagement of the screw threads 54*a* and 54*b*, rotation of the bolt member inside the sleeve causes a linear displacement of the bolt member 56 with respect to the sleeve 52.

The sleeve 52 is coupled to the body of the motor 46 by means of a coupler 58, and the bolt member 56 is coupled to the rotating shaft 47. While one end of the bolt member 56 is coupled to the rotating shaft 47 the opposing end thereof is coupled to the plunger 42 directly or by means of a rotating coupler 60. The rotating coupler can be configured such that the rotational displacement of the bolt member 56 is not transferred to the plunger 42, such that the plunger is only linearly displaced inside the compartment 20.

According to an example the plunger 42 is disposable, i.e. it is design to be replaced when a new wax rod is inserted into the compartment 20. This way, the plunger 42 which may include wax residue does not have to be cleaned rather it is replaced with a new plunger. Accordingly, the rotating coupler 60 is configured to removably couple the plunger 42 thereto, such as by snap coupling etc.

It is appreciated that as the bolt member 56 is rotated inside the sleeve 52, it is also linearly displaced along the sleeve 52. Thus, as the bolt member 56 is displaced towards the compartment 20 it reaches the end of the screw thread 54*a* of the sleeve, as which point the bolt member 56 can no longer more forwards and must be rotated reversely, so the bolt member 56 is linearly displaced back towards the motor 46. It is appreciated that the bolt member 56 and the sleeve 52 are configured such that the outmost position of the bolt member 56 with respect to the sleeve 52 correspond to the inmost position of the plunger 42 with respect to the compartment 20, i.e. the plunger 42 is fully inserted inside the compartment 20.

According to an example, the motor is configured to rotate in a first direction such that the bolt member 56 is displaced inside the sleeve 52 towards the compartment 20, and in a second direction by which the bolt member 56 is displaced inside the sleeve 52 away from the compartment 20. According to an example the motor 46 is configured to automatically change the rotational direction thereof as the bolt member 56 reaches its outmost position with respect to the sleeve 52, and this point the bolt member 56 is rotated back until the bolt member 56 is fully disposed inside the sleeve 52, and consequently the plunger 42 is out of the compartment 20. This way, when the bolt member 56 reaches its out most position, and the plunger 42 is in it innermost position inside the compartment 20, the wax is substantially out of the compartment 20. When the motor switches it rotational direction, the bolt member 56 is displaced back until it is fully disposed inside the sleeve 52, and consequently the plunger 42 is pulled out of the compartment 20, allowing the user to insert a new wax rod to the compartment 20.

The apparatus 10 further includes an actuator 65 mounted on the outer surface of the housing 12 and configured such that a short press thereon causes a slight rotation of the motor 46 and consequently a slight forward movement of the plunger 42 inside the compartment 20. This way the user can controller the amount of melted wax which is dispensed on the applicator 16.

Those skilled in the art to which the presently disclosed subject matter pertains will readily appreciate that numerous changes, variations, and modifications can be made without departing from the scope of the invention, mutatis mutandis.

The invention claimed is:

1. A waxing apparatus comprising:

a dispenser having a compartment for holding wax and a tip having an aperture for dispensing wax on a user skin, said tip including a gradually decreasing cross section in the direction towards said aperture;

a heating element mounted over said compartment and over said tip and configured such that temperature inside the tip is higher than temperature inside the compartment;

a dispensing mechanism for dispensing the wax out of the compartment;

wherein said dispensing mechanism includes a plunger configured to be inserted into the compartment and to urge the wax therein towards the tip and wherein said dispensing mechanism further includes a motor and a motion converter for converting rotational motion of said motor to linear motion; said motion converter is coupled to said plunger and configured to urge said plunger inside said compartment; and wherein said motion converter includes a sleeve having a screw thread defined on an inner surface thereof, and a bolt member having a corresponding screw thread defined on an outer surface thereof, wherein said bolt member is configured to rotate inside said sleeve, such that by engagement of said screw threads, rotation of the bolt member inside the sleeve causes a linear displacement of the bolt member with respect to the sleeve.

2. The waxing apparatus according to claim 1 further comprising an applicator for applying the wax on a surface the skin.

3. The waxing apparatus according to claim 2 wherein said applicator includes an edge configured sized and shaped in accordance with a skin surface on which melted wax is to be applied.

4. The waxing apparatus according to claim 2 wherein the applicator is replaceably mounted on the dispenser such that various applicators can be used for various skins surfaces.

5. The waxing apparatus according to claim 1 further comprising a housing and wherein said dispenser includes the wax compartment having an insertion opening for inserting therein wax, and wherein said dispenser is a removably coupled to said housing allowing thereby insertion of the wax to said wax compartment.

6. The waxing apparatus according to claim 1 wherein said heating element is configured to form a temperature gradient inside the compartment and said tip in the direction from said compartment to said aperture.

7. The waxing apparatus according to claim 1 wherein the heating element is configured such that temperature of the wax in said tip is higher than temperature of portions of the wax disposed in said compartment.

8. The waxing apparatus according to claim 1 wherein said heating element is configured to heat the wax inside the tip to a temperature of 50-65° Celsius and to heat the wax in the compartment to a temperature of 45-50° Celsius.

9. The waxing apparatus according to claim 1 wherein said heating element is configured such that the wax inside the compartment is relatively rigid with respect to wax inside the tip.

10. The waxing apparatus according to claim 1 wherein said dispenser includes a casing member configured to encase the compartment as well as the heating element, and includes flange configured for removable coupling to a corresponding flange on a housing of the apparatus.

11. The waxing apparatus according to claim 1 wherein said plunger further includes a conic head corresponding to a conic head of said tip.

12. The waxing apparatus according to claim 1 wherein said sleeve is coupled to said motor and said bolt member is coupled to a rotating shaft of said motor, such that rotation of said shaft facilitate liner displacement of said bolt member with respect to the sleeve.

13. The waxing apparatus according to claim 1 wherein said bolt member and said sleeve are configured such that an outmost position of said bolt member with respect to said sleeve corresponds to an inmost position of said plunger with respect to said compartment.

14. The waxing apparatus according to claim 13 wherein said motor is configured to rotate in a first direction such that said bolt member is displaced inside said sleeve towards said compartment, and in a second direction by which said bolt member is displaced inside said sleeve away from said compartment.

15. The waxing apparatus according to claim 14 wherein said motor is configured to automatically change the rotational direction from said first direction to said second direction as the bolt member reaches said outmost position and to change the rotational direction from said second direction to said first direction when said bolt member is fully disposed inside said sleeve.

16. The waxing apparatus according to claim 15 further comprising an actuator configured for controlling the duration of rotation of said motor controlling thereby the amount of melted wax which is dispensed from said dispenser.

* * * * *